US008181411B2

(12) United States Patent
García Viar

(10) Patent No.: US 8,181,411 B2
(45) Date of Patent: May 22, 2012

(54) CONSTRUCTION COMPONENT AND METHOD FOR PRODUCING A CONSTRUCTION COMPONENT

(75) Inventor: Luis García Viar, Cadiz (ES)

(73) Assignee: Luis García Viar, Benalup-Casas Viejas, Cádiz (ES)

( * ) Notice: Subject to any disclaimer, the term of this patent is extended or adjusted under 35 U.S.C. 154(b) by 274 days.

(21) Appl. No.: 12/612,308

(22) Filed: Nov. 4, 2009

(65) Prior Publication Data

US 2011/0099927 A1 May 5, 2011

(51) Int. Cl.
*E04C 2/52* (2006.01)

(52) U.S. Cl. ..... 52/439; 52/437; 52/309.11

(58) Field of Classification Search ..... 52/220.2, 52/421, 429, 435, 437, 439, 569, 220.3, 309.11
See application file for complete search history.

(56) References Cited

U.S. PATENT DOCUMENTS

| | | | | |
|---|---|---|---|---|
| 1,035,206 | A * | 8/1912 | Lewen | 52/422 |
| 1,087,969 | A * | 2/1914 | Murray et al. | 52/220.3 |
| 2,356,309 | A * | 8/1944 | Garbe | 52/481.2 |
| 4,241,555 | A * | 12/1980 | Dickens et al. | 52/454 |
| 6,357,191 | B1 * | 3/2002 | Ault et al. | 52/336 |
| 6,418,686 | B1 * | 7/2002 | Record | 52/309.15 |

* cited by examiner

*Primary Examiner* — Basil Katcheves
(74) *Attorney, Agent, or Firm* — K&L Gates LLP

(57) ABSTRACT

A construction component is described. The construction component may include: a) a permanent formwork constituted by a pair of separate semi-forms, facing each other and defining a hollow space between them; b) a construction setting material arranged inside the hollow space; and c) auxiliary installations, such as piping, wiring, or cabling. In one example, each semi-form includes a metal plate fitted with protuberances projecting from one side of the metal plate towards the construction setting material, and with slots housing the auxiliary installations. In another example, each semi-form includes a plastic plate, wherein one of the plastic plates is fitted with protuberances and the other plastic plate is fitted with slots. The example method may include arranging of the auxiliary installations in the slots; and arrangement of two semi-forms and subsequent filling with the construction material until it sets; and optionally connecting the systems and/or installing of the coating components.

9 Claims, 5 Drawing Sheets

CONSTRUCTION COMPONENT AND METHOD FOR PRODUCING A CONSTRUCTION COMPONENT

BACKGROUND

There are many existing construction systems using many types of materials. In most developed countries, activities related to construction constitute an important engine of the economy.

The higher the degree of development of a country, the higher the scarcity of labour force and, consequently, solutions which permit the saving of labour force are welcome, whether by mechanizing construction processes, or by improving the performance of all the activities which are part of construction. Development itself involves compliance with ever more demanding regulations due to reasons of security, comfort and respect for nature.

Prefabricated elements nowadays play central roles in the construction of all buildings, whether they are for the structural work or for the complementary formation works such as roofs, retaining walls or partitions of all types. There is a trend of referring certain processes to integral manufacturing plants for prefabricated elements which can be easily and efficiently used in the civic work where they are required.

DETAILED DESCRIPTION OF EXAMPLE EMBODIMENTS

Figure 1:
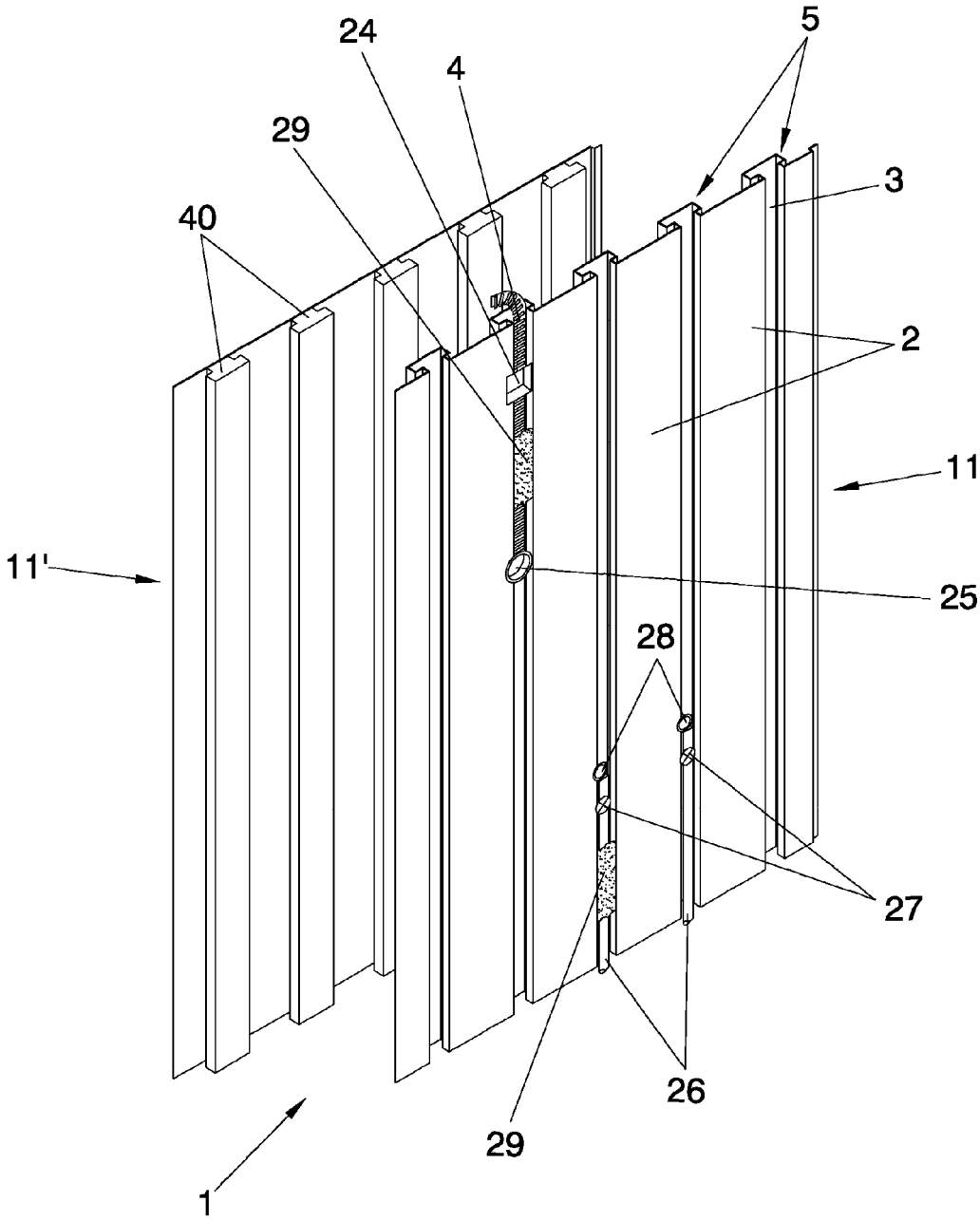
FIG. 1 shows two example semi-forms facing each other and arranged in vertical position, according to an example embodiment of the present invention.

The use of prefabricated components normally requires complementary operations for surface finishing or for the formation of grooves intended to house the usual water, electricity, television wiring or other similar systems. Lightweight material panels may have built-in pipes, cable trays, connection boxes and other complements which facilitate the building work.

Some example embodiments of the present invention are in the technical field of construction, and specifically in the field of construction systems and components.

Some example embodiments of the present invention provide a construction component that can be manufactured in a particularly fast and efficient manner, and while also allowing precision in the finishing of the component and/or structures built using the component.

Some example embodiments of the present invention include the provision of a construction component of the wall or partition type, which can be built with greater efficiency, speed and perfection in the finishing than those previously known construction components.

Some other example embodiments of the present invention include a method for building construction components.

In one example embodiment of the present invention, a construction component includes a construction setting material arranged inside a permanent formwork, wherein the permanent formwork is adapted in its geometry to remain solidly attached to the construction material during the setting of the construction material.

The permanent formwork may include by a pair of semi-forms, equipped with fastening protuberances extending into and/or recesses receiving the construction material. The semi-forms may be arranged facing each other, and the construction setting material may be poured between the semi-forms.

The protuberances and recesses may define slots that provide one or more of the following:

- fastening during the setting of the construction material between the construction material and the semi-forms, by holding the semi-forms together with the construction material;
- holding and fastening different coating components used for finishing of the construction component, by allowing the insertion of a respective collaborating fitting in the inner space of each slot to be used in the anchoring of coating components;
- permitting the insertion of a bar of wood or other material into the slots to achieve wooden, outer and inner finishing, screwing or nailing coating components to the bars;
- permit the passage of systems such as electrical, plumbing, telephone, etc. systems;
- permitting the placement of anchor clips to attach the construction systems of ventilated facades;
- facilitating various types of finishing, such as plaster or gypsum sheets, door and window frames, etc., which can be screwed onto the semi-forms with self-tapping screws;
- permitting the anchoring, fastening, attaching, nailing or screwing of all types of surface finishing components on the outer part of the semi-forms, which a considerable saving in time and labour force with respect to the conventional fastening or anchoring techniques;

Additionally, the space provided by the recesses and the protuberances, in many possible cross-sectional configurations, may also be used as channelling to house any type of piping, duct, wiring or the like, or any other component associated with those different services and supplies, providing both an easy and quick installation of these types of components, and in some cases also providing suitable protection thereof.

The protuberances and recesses may have many varied cross-sections, both of regular and irregular geometries, and may consequently be rectangular, circular, trapezoidal or of any other shape, leaving an inner space large enough to allow the insertion of the aforementioned anchoring fittings of coating components, of the profile-type or of any other configuration. The anchoring fittings can be solidly joined to respective internal fittings with the assistance of pin bolts, screws, nails, or other fasteners which, passing through a frontal aperture, may be attached to the corresponding internal fitting.

In accordance with another example embodiment, the recesses and the protuberances are used to anchor external fittings with the aid of pin bolts or screws which pass through the longitudinal apertures and whose heads, of a larger diameter than the aperture, are housed inside.

According to another example embodiment, the recesses and the protuberances permit the application of intermediate spacers which keep the separation between the semi-forms of both faces constant, in accordance with the thickness planned for the wall or partition to be built using the construction components In addition to the specific examples described herein, the use of the described semi-forms may also provide an improvement in the building of construction components, such as walls and partitions. The semi-forms may also simplify construction and considerably reduce the time invested in such operations, while at the same time providing flat surfaces, duly prepared to receive and fasten the coating and finishing components provided or otherwise to produce finished building work.

According to another example embodiment of the invention, the semi-forms may be formed from metal plates, such as black plates, zinc-coated plates, galvanized plates, lacquered plates, plastic-coated plates, or any other of similar nature, of a thickness which is preferably between 0.50 and 0.75 mm. The plates may be shaped with conventional shaping methods, for example by folding or drawing. In this case, the protuberances and recesses may be defined in the plate by the shaping method itself, whether it is folding, drawing or other conventional metal forming methods. Each metal plate may be fitted with protuberances projecting from one side of the metal plate towards the construction setting material, and with slots defined in correspondence with the protuberances on the other side of the metal plate. The slots may house auxiliary installations, such as piping, conduit, wiring, cables, etc.

For semi-forms manufactured from metal plate, the semi-forms can incorporate stiffening projections which, similar to the protuberances and the recesses, can be shaped by drawing or folding, preferably, and which provide the semi-forms with greater rigidity and strength. The stiffening projections may include, e.g., rectangular forms of substantially smaller dimensions than the protuberances and the recesses.

In another example, the semi-forms may be made from plastic (e.g., polymeric) materials, reinforced or not, such as polyester fibre glass, PVC, etc. One of the semi-forms may be fitted with protuberances projecting from one side of the plastic plate, and the other semi-form is fitted with slots housing the auxiliary installations.

In the case of semi-forms built with plastic plates, the recesses, both inner and outer, can be created as part of the manufacturing process for the semi-form. For example, the protuberances may be integrally moulded or cast as part of the semi-forms. In the same manner, the protuberances can be provided by bars, e.g. wooden bars fastened on the inner side of the semi-forms. The shape (e.g., trapezoidal or operationally equivalent) of the cross-section of the bars may permit a fastening between the semi-form, the bar and the construction material wherefrom the wall or partition is manufactured.

Also alternatively, in the case of semi-forms manufactured with plates of plastic material, the plates themselves can be hollow and be filled with a water-proof agglomerate.

Some example embodiments of the present invention may provide a method for producing wall- or partition-type construction component by using the aforementioned semi-forms.

The example method may include three main stages, in addition to a preliminary production stage. The preliminary production stage of a construction project may include creation of plans and details for the design, including defining the measurement of the formwork to be used and the design of the systems which must run through each one of the construction components.

In the first construction phase, the semi-forms positioned on a floor are comfortably worked with so that the planned auxiliary systems (e.g., electric, water, communications channelling, etc.) can be placed in the corresponding slots, subsequently securing the planned auxiliary systems in place by casting a polyurethane foam filling or similar product. More commonly, such systems are vertical, even though it is possibly advisable to make a cut to place, depending on dimensions, the cable box, mechanism box, or some horizontal or oblique channelling of short length. The need for vertical cuts may be based on the physical design of the semi-forms which may have the slots in the vertical direction. In the upper or lower part, as applicable, appropriate installations will be left for the subsequent connections which may run through a false ceiling or floating floor.

To finish up this first phase the desired fittings may need to be placed in the slots which will eventually serve to reinforce the coating and finishing components planned in the project.

The first phase being completed, the second phase may be carried out. The second phase may include lifting the semi-forms with all of the auxiliary systems and fittings built-in during the first phase, thereby positioning the semi-forms vertically and using them traditionally as permanent formworks. The semi-forms may be arranged in pairs to define both sides of the construction components, supporting the semi-forms on foundation bases, termporarily securing the semi-forms vertically with braces, or using alternative support and securing approaches. The distance between semi-forms may be fixed with spacing components, e.g., temporary spacers, prior to filling the forms with the filling material (concrete, lightweight mortar or plastic foams, for example). After filling, and any required setting, the filling will maintain both the verticality and the distance between the semi-forms, which may be important in the final finishing.

Lastly, once any needed setting of the filling for the construction component has occurred, so that a filling acquires the suitable consistency and strength has been produced, the third phase may be started. The third phase may include, completing the electricity, water, communications or any other type of auxiliary systems and, following this, placing the coating components planned for the project, e.g., by attaching them to the construction component as specified in each case using nails, lag screws, screws/nuts, etc.

The construction system and method described above may have several advantages with respect to other more traditional methods. One advantage may be the cheapening of the final product stemming from the important reduction in labour force costs as a consequence of the quickness with which the building is carried out.

Furthermore, the programming, the meticulous preparation of the work to be done and the quickness of the construction may have a direct impact on the improvement in efficiency, on the overall performance and on the decrease in the financial costs.

Additionally, the described method may reduce transportation costs, as one may only need to stock up on the semi-forms, finishing materials and system fittings; the construction material, such as mortar or such like, may be supplied in cement mixers and may be pumped. Thus, when fillings based on lightweight mortars and polyurethane foams are used, the total loads may be less than those of the traditional construction systems.

The use of the described semi-forms may permit an accurate preparation of hollow spaces, windows and doors which may be perfectly built, including anchors, and possibly avoiding the use of frames in doors and windows.

As an added advantage, the example-forms themselves may provide not only the waterproofing of the facades but also noticeable improvements from the acoustic and thermal standpoints.

The use of modular wiring systems may be particularly interesting. In modular electrical systems, the main switchboard, as well as all of the wiring in the housing or, in general, in the building, arrives in the workshop already prepared, the terminals for the wires having been installed and duly numbered, so that the on site installation can be carried out by the workers themselves, since the route and installation of each wire is specified in a plan. This modular electrical installation system achieves an improvement in quality of installation, as well as a savings in labour force and, in general, in costs.

To better describe the example forms and method of construction, of the attached drawings, wherethrough these drawings use the same numeric references to designate the equal or similar parts.

FIRST EXAMPLE

Semi-Form Plates

Referring in the first place to FIG. 1, a schematic view can be observed, viewed from an overhead perspective, of an example permanent formwork (1) in accordance with an example embodiment of the present invention, made up of two semi-forms (11, 11') which may be manufactured from folded or drawn metal plate, and which may adopt a substantially flat configuration, wherefrom one of whose faces project multiple protuberances (5) and recesses (2), built into the body of the semi-form (11, 11'), extending in the longitudinal direction of the semi-form (11, 11'), equal and parallel to each other, and in successively equidistant positions.

The protuberances (5) and the recesses (2) may feature a profile whose cross-section can adopt different alternative forms. The protuberances (5) may be projected from one side of the metal plate and slots (3) may be defined in correspondence with the protuberances (5) in the other side of the plate.

Figure 2:
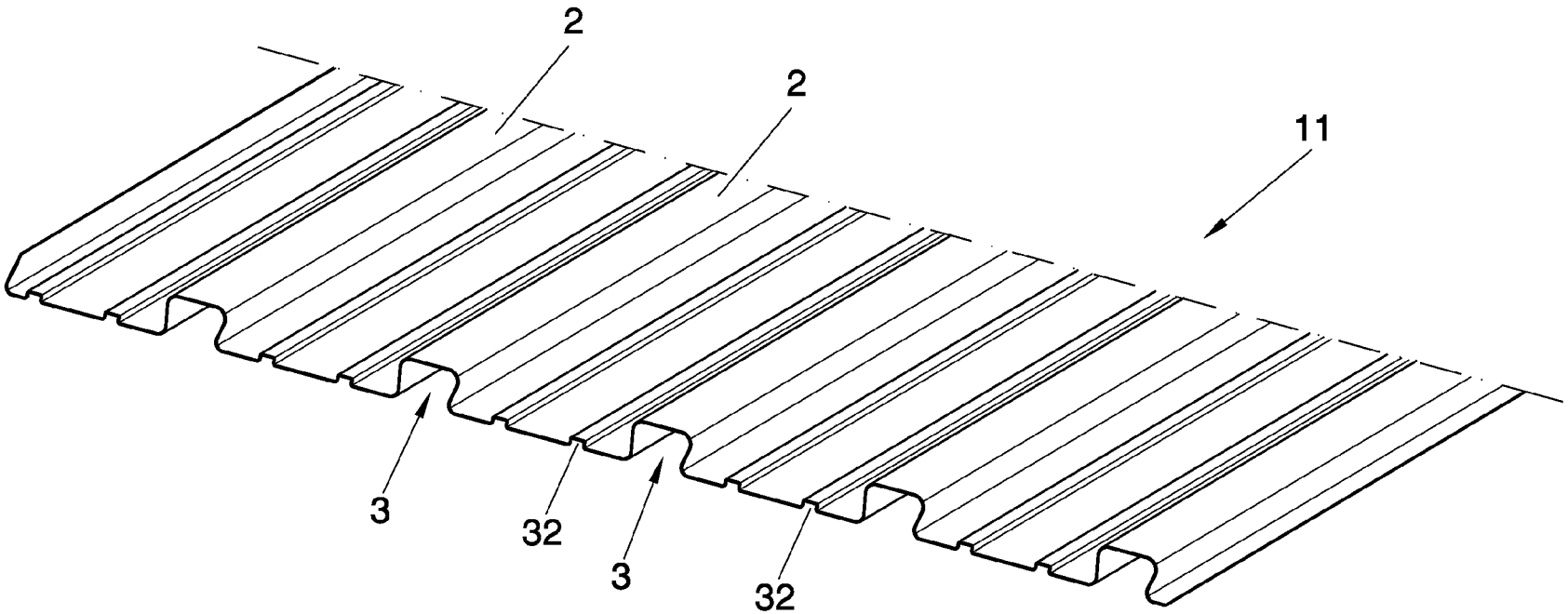
FIG. 2 shows a perspective view of an example semi-form manufactured from metal plate that may include stiffening projections inserted between the protuberances, according to an example embodiment of the present invention.

FIG. 2 illustrates an example semi-form (11, 11') additionally incorporates stiffening projections (32) defined between the protuberances (5), which may provide greater rigidity and strength.

Figure 4:
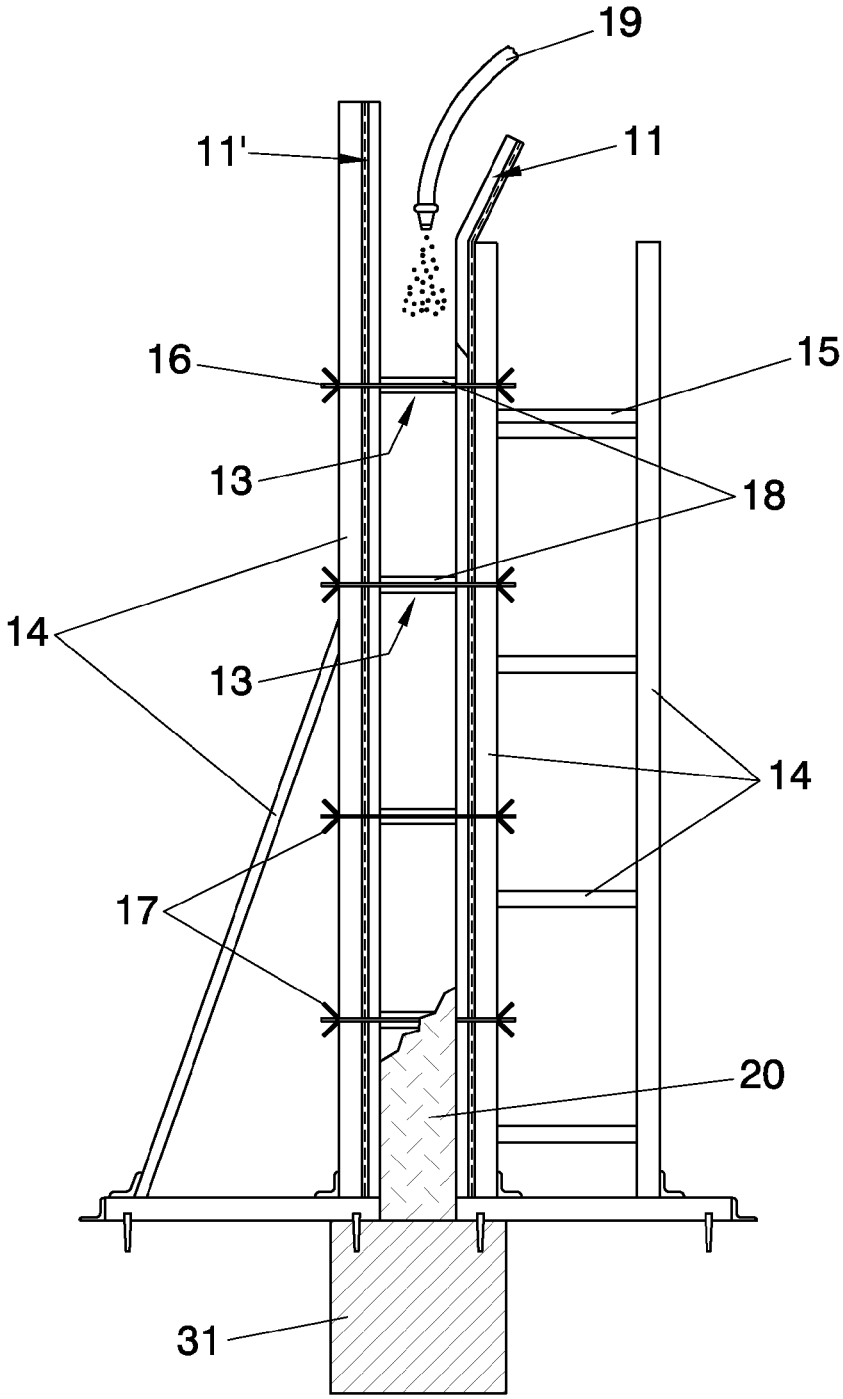
FIG. 4 represents the general arrangement of the different components which take part in an example forming and concreting process for the formation of a partition, according to an example embodiment of the present invention.

FIG. 4 schematically shows a wall or such like under construction, whose external faces may be delimited by an array of semi-forms (11, 11'). The semi-forms may be successively aligned by each one of the sides of the wall, and may be separated by a pre-set distance which defines the thickness of the wall or partition once the space between the semi-forms is filled with a construction material (20). As can be observed (see FIG. 1), the protuberances (5) and the recesses (2) may maintain the semi-forms (11, 11') in their position, fitting in the construction material (20) once the construction material (20) has set. On the external face, the slots (3) may be left uncovered to fasten an outer coating (7).

Figure 5:
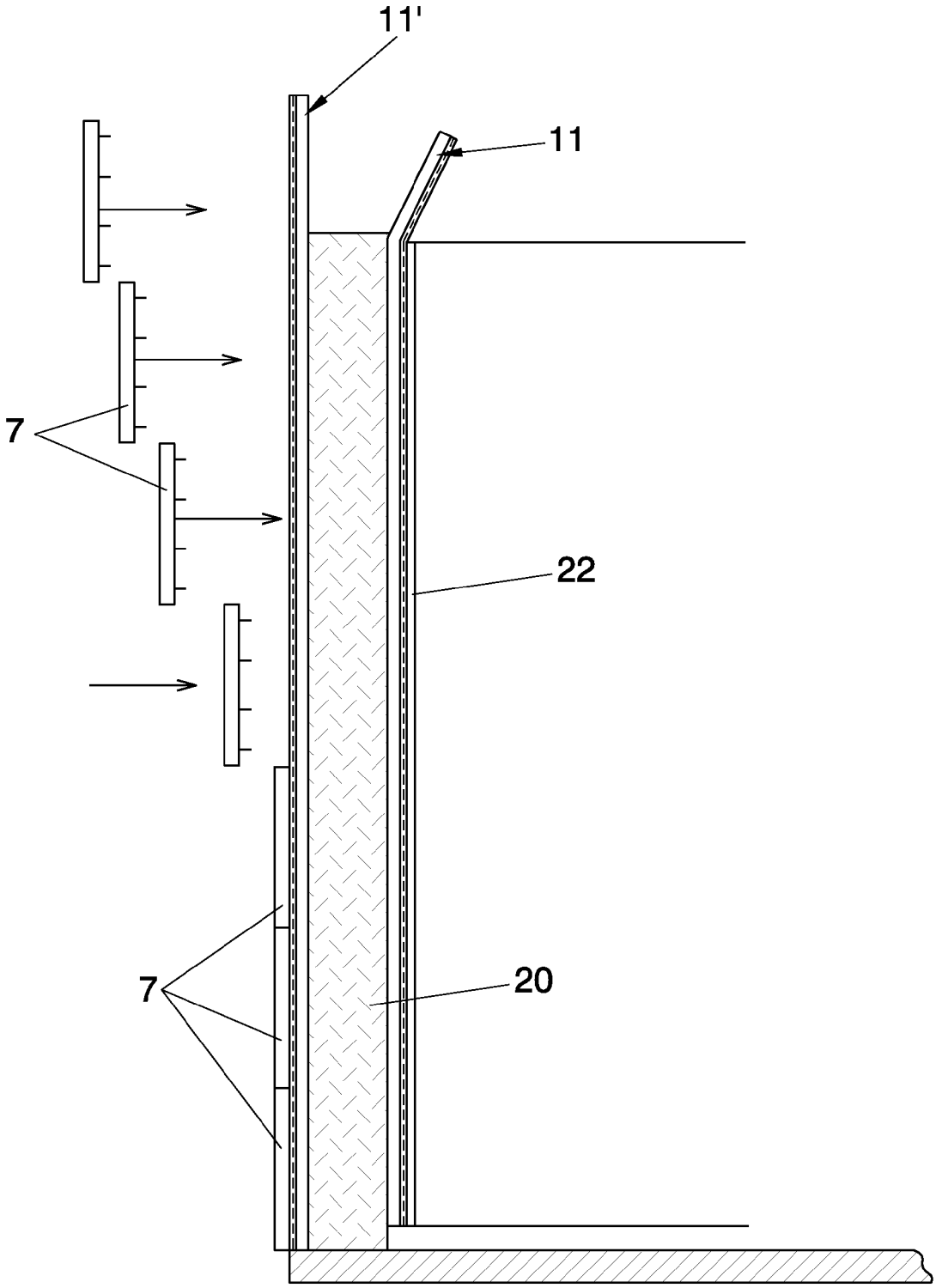
FIG. 5 represents the final phase of the example construction method, wherein the temporary support structures are eliminated and the inner and outer surfaces are coated, according to an example embodiment of the present invention.

In FIG. 5, a schematic view can be observed wherein example semi-forms (11, 11') are positioned vertically on both sides of a wall or such like under construction with the use of mortar, concrete or other material (20), where the thickness of the wall is precisely determined by the separation between the example semi-forms (11, 11'). Thanks to the configuration of the recesses (2) (see FIG. 1), a multiplicity of spacers (13), which will be described below in greater detail, can be coupled.

The coupling using spacers (13) may immobilise a semi-form (11) from one side of the wall with respect to the semi-form (11') of the opposite side of the wall, thereby guaranteeing the maintenance of the uniformity of the thickness of the wall. These spacers (13) may be buried by the construction material (20) of the wall, thereby helping reinforce the wall after the setting of the construction material (20).

SECOND EXAMPLE

Plastic Semi-Forms

Figure 3A:
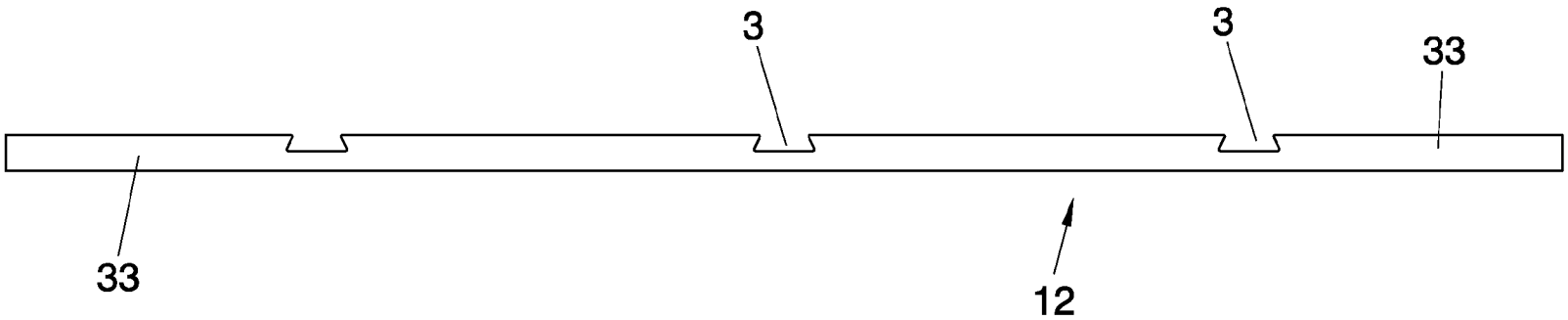
FIG. 3*a* shows an example semi-form including hollow plates of plastic material filled with a waterproof agglomerate with recesses, according to an example embodiment of the present invention.
Figure 3B:
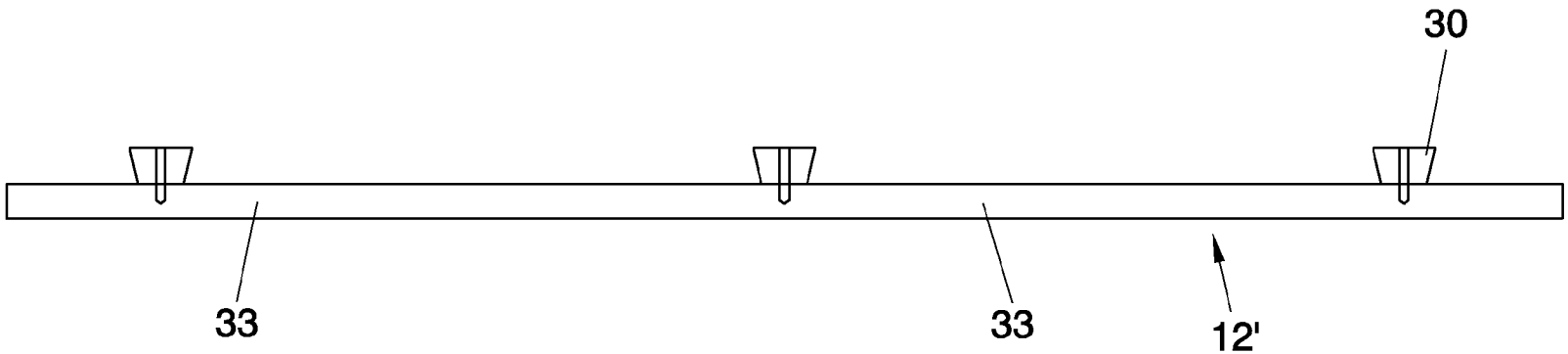
FIG. 3*b* shows another example semi-form including plates of plastic material filled with a water-proof agglomerate with bars in the form of protuberances, according to another example embodiment of the present invention.

Two example of semi-forms (12, 12') built from plates of plastic material are observed in FIGS. 3*a* and 3*b*.

The protuberances (5) and/or the recesses (2) may feature a profile whose cross-section can adopt different alternative shapes, to form inner housings which are accessible through a longitudinal slot (3) of considerably smaller width than that of the housing space.

A semi-form (12) is observed in FIG. 3*a* which is may be manufactured with hollow plates of plastic materials provided with a water-proof agglomerate filling (33). The semi-form (12) may be fitted with slots (3) housing auxiliary installations.

A semi-form (12') is observed in FIG. 3*b* which may be produced with hollow plastic plates that may be filled of water-proof agglomerate (33). The plastic plates may include protuberances including bars (30) fastened on the inside of the semi-form (12'). The protuberances (5) may project from one side of the semi-form.

THIRD EXAMPLE

Production Method

An example construction method used in the production of walls or partitions using the semi-forms (11, 11') previously described as permanent formwork (1) is described below again with help of FIGS. 1, 4 and 5. The method may be carried out according to the following three phases, although it will be appreciated that other tasks may be incorporated in the example method:

First Phase. 13 (See FIG. 1)

Once the dimensions of an inner semi-form (11) and an outer semi-form (11') are known, the semi-forms (11, 11') may be placed horizontally or in the position which is considered to be most suitable. In the inner semi-form (11), flexible tubes for electrical pipes (4), junction boxes (24), boxes for switches or plugs (25), pipes for the conduction of water (26) with their stopcocks (27) and outlet connectors for pigtails (28) may be positioned. The installation of the Installations the upper and lower part may be partially delayed, so that when it is time to proceed to the splicing with the systems which run on a false roof or under a floating floor may be accomplished. Once the placement of all the necessary components on the corresponding slots (3) has been finished, the components may be secured and immobilised in their position with a foam polyurethane filling (29) or similar product.

The outer semi-form (11') may be equipped with fittings for the holding of coating components (7), such as wooden bars (40), hooks, blind plugs, special screws, etc., whose operation is facilitated as all of these components can be strengthened on slots (3). In the case represented in FIG. 1, wooden bars (40) have been decided upon. The wooden bars may be fitted into the slots (3). The fitting is facilitated by preparing the cross-section of the wooden bars so that they can slide snugly inside the slots (3) without the possibility of them coming out when they have to work as support for the coating components (7). Another possibility is to fasten the bars (40) to the semi-forms (11, 11') by means of lag screws (not represented).

Second Phase. —(See FIG. 4)

In this second phase, the semi-forms (11, 11') may be lifted with all of the components installed thereon. The components may be immobilised with respect to the semi-form by the foam filling (29) (see FIG. 1) placed for this purpose. Then, the semi-forms (11, 11') are placed precisely on the firm floor, or on the foundation (31) built for this purpose, fastening the semi-forms with provisional support structures (14), guaranteeing the uniform separation of the semi-forms (11, 11') using spacers (13) which incorporate cladding (18), and the solidity of the array with threaded bars (16) and nuts (17). Taking advantage of the support structure (14), scaffolding boards (15) can be placed, as is normal in constructions.

Lastly, the construction material (20), which can be, e.g., concrete, mortar or the type of mixture chosen for the project, may be pumped, pouring it through a supply hose (19) in the space between both semi-forms (11, 11') which, as has been indicated, act as permanent formwork (1).

Once the setting period for the construction material has passed, the support structure (14), scaffolding boards (15) and the rest of the components such as nuts (17) and threaded bars (16) may be removed.

Third Phase. —(See FIG. 5)

The finishing operations may be performed in this phase:

a) systems, making the correct connections from the installations which have remained visible.

b) inner facing, e.g., adding a layer of plaster (22) or any other type of finishing which is considered appropriate for the particular construction project.

c) an outer facing, placing the coating tiles (7), which may be nailed on the wooden bars (30) (see FIG. 1).

The invention claimed is:

1. A construction component, comprising:

a permanent formwork including a pair of separate semi-forms, each semi-form including a plate having the same shape, each plate having an inner side and an outer side, the inner sides of the pair of semi-forms facing each other and defining a space between them;

a construction setting material arranged inside said space, each semi-form having a plurality of protuberances projecting from the inner sides of the plates towards the construction setting material;

a plurality of longitudinal slots defined on the outer sides of the plates in correspondence with said protuberances;

auxiliary installations housed in said longitudinal slots; and coating components fixed to the semi-forms by fasteners housed in said longitudinal slots.

2. The construction component of claim 1, wherein each plate is fitted with stiffening projections located between the protuberances.

3. The construction component of claim 1, wherein the auxiliary installations include at least one of water pipes, electrical wiring, or fibre optics cables.

4. The construction component of claim 1, wherein the coating component is a plaster coating.

5. The construction component of claim 1, wherein the plates are metal.

6. The construction component of claim 1, wherein the plates are formed from a plastic material.

7. The construction component of claim 6, wherein the plastic material is a polymeric material.

8. The construction component of claim 6, wherein the plastic plates are hollow and are filled with water-proof agglomerate.

9. The construction component of claim 1, wherein the protuberances include bars.

* * * * *